US012515118B2

(12) United States Patent
Schule

(10) Patent No.: US 12,515,118 B2
(45) Date of Patent: Jan. 6, 2026

(54) MULTI-ROUND WAGER ACCUMULATION GAME

(71) Applicant: Ralph Anthony Schule, Glendale, AZ (US)

(72) Inventor: Ralph Anthony Schule, Glendale, AZ (US)

( * ) Notice: Subject to any disclaimer, the term of this patent is extended or adjusted under 35 U.S.C. 154(b) by 0 days.

(21) Appl. No.: 17/460,251

(22) Filed: Aug. 29, 2021

(65) Prior Publication Data

US 2023/0062828 A1 Mar. 2, 2023

(51) Int. Cl.

| | |
|---|---|
| ***A63F 1/00*** | (2006.01) |
| ***A63F 1/02*** | (2006.01) |
| ***A63F 1/04*** | (2006.01) |
| ***A63F 1/06*** | (2006.01) |

(52) U.S. Cl.

CPC ..... *A63F 1/04* (2013.01); *A63F 1/02* (2013.01); *A63F 1/067* (2013.01); *A63F 2001/0458* (2013.01)

(58) Field of Classification Search

None

See application file for complete search history.

(56) References Cited

U.S. PATENT DOCUMENTS

| | | | | |
|---|---|---|---|---|
| 6,299,171 | B1 * | 10/2001 | Mollo | A63F 3/00157 273/292 |
| 6,371,484 | B1 * | 4/2002 | Yuan | A63F 3/00157 273/274 |
| 10,909,814 | B2 * | 2/2021 | Hauser | G07F 17/3293 |

* cited by examiner

*Primary Examiner* — Sunit Pandya

(57) ABSTRACT

A new system for wager accumulation gaming between dealer and up to six players. The system offering the exciting gaming feature of "Advantaged Play," by providing, with sufficient wager accumulation, payout out odds greater than odds of winning under a fast-paced game for a player to win and for the house to quickly collect commissions. The system also provides the exciting feature of exit winning wherein a player who exits the game before conclusion will automatically win back a prorated amount of accumulated wagering, less dealer commission. The system also provides the exciting feature of a tie game wherein after ten rounds of game play, the dealer will declare the game a tie and return accumulated wagering to players by prorated amounts, less dealer commission. The system also provides the feature of partnership play for a prospective player not currently in the game to request partnership with a player currently in the game with current player accepting or rejecting partnership, all of which is under control of the dealer.

5 Claims, 15 Drawing Sheets

Figure 1:
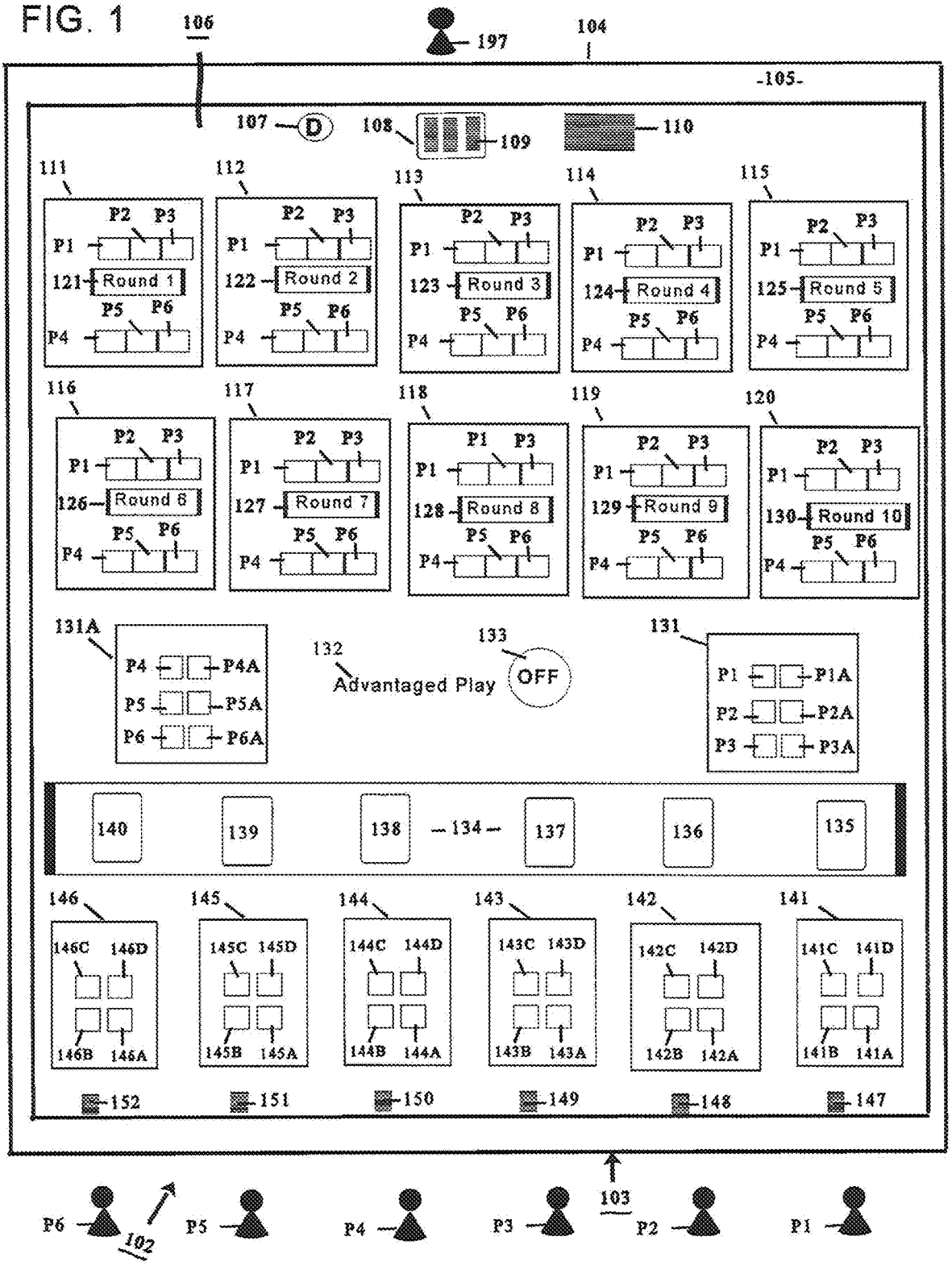

Card Deck, Quantity 50 Cards — 110

1/2 Pot Cards, Quanity 10 Cards — 154

Build, Quanity 40 Cards — 156

Probabilty of winning (3.67%) — 158

Odds of winning (27.22 : 1) — 160

One million games computer simulation — 162

| Rounds | Probability of wagers accumulating to the next round — 162A |
|---|---|
| 1 | 79.28% |
| 2 | 61.57% |
| 3 | 46.65% |
| 4 | 34.31% |
| 5 | 24.28% |
| 6 | 19.29% |
| 7 | 14.97% |
| 8 | 11.38% |
| 9 | 8.37% |
| 10 | 0.00% |

FIG. 3

| Rounds | | Odds of Winning Hand | Payout Odds/ Accumulated Wagers* | Advantaged Play |
|---|---|---|---|---|
| 1 | | 27.22 : 1 | 6 — 164 | No |
| 2 | | 27.22 : 1 | 12 | No |
| 3 | | 27.22 : 1 | 18 | No |
| 4 | 168 — | 27.22 : 1 | 24 | No |
| 5 | | 27.22 : 1 | 30 | Yes — 170 |
| 6 | | 27.22 : 1 | 36 | 170A — Yes |
| 7 | | 27.22 : 1 | 42 | Yes — 170B |
| 8 | | 27.22 : 1 | 48 | 170C — Yes |
| 9 | | 27.22 : 1 | 54 | Yes — 170D |
| 10 | | 27.22 : 1 | 60 — 166 | 170E — Yes |

* Six players per round

MULTI-ROUND WAGER ACCUMULATION GAME

CROSS-REFERENCE TO RELATED APPLICATIONS

This application claims priority from U.S. Provisional Patent Application No. 63/072,218 filed 30, of Aug., 2020, and Titled NOVEL CASINO TABLE GAME, which application is incorporate herein by reference in its entirety.

STATEMENT REGARDING FEDERALLY SPONSORED RESEARCH OR DEVELOPMENT-n/a

THE NAMES OF THE PARTIES TO A JOINT AGREEMENT-n/a

REFERENCE TO A SEQUENTIAL LISTING-n/a

STATEMENT REGARDING PRIOR DISCLOSURES BY THE INVENTOR-n/a

BACKGROUND OF THE INVENTION

1. Field of the Invention

The present invention relates to the field of wagering events.

2. Background of the Art

The landscape of casino table game innovation has been firmly shaped by the U.S. Court of Appeals in Smith, 2015-1164, which affirmed U.S Supreme Court, Alice Corp, V. CLS Bank International. The Inventor has firmly considered requirement of innovation as affirmed by Smith and brings forward system of invention with sufficient innovative concept.

Casinos are always in a state of reinvention, especially after the Covid-19 pandemic. While aspects such as hotel decor and entertainment are constantly being reinvented, casino table gaming has remained stagnant by employing a standard deck of playing cards with odds of losing greater than odds of winning. The appended system of innovation has created a custom deck of fifty cards consisting of forty build cards and ten ½ pot cards designed for multi-round wager accumulation. Any player who receives a build card in any order will be immediately eliminated from the round. Any player, who receives in immediate succession, back-to-back, ½ pot cards, will be declared the game winner and awarded all accumulated wagers. In the event of no winning combination of cards, the game will continue to the next round with resultant wager accumulation. If after ten rounds of play and without benefit of a winning hand of cards, the game will be declared a tie with accumulated wagers returned pro rata to any player who made standard wager in round ten of the game.

Prior art of skill-based card games are comparatively slow in game play due to complex rules that could require a deal of up to seven cards from a standard fifty-two card deck. The system of the invention usually requires only one card to be dealt and in other cases never more than two cards from custom deck of fifty cards, thereby greatly increasing speed of game.

Prior art of wager accumulation for card games game like Pai Gow, typically provides for an environment of long-term jackpots accumulating over a series of days or sometimes months. The system of the invention provides for an extremely quick duration of wager accumulation, which in the preferred embodiment of the invention could last one round or accumulate wagers through a maximum of ten rounds of play. Prior art of wager accumulation could last months as compared to the system of the invention which will last minutes.

Prior art of wager accumulation is typically one of comingling wagers into a single pot without regard to player or round. The system of the invention has crafted a custom table layout which segregates accumulated wagers by both round and player.

The system of the invention provides avenue of exit for players who wish to exit the game before its conclusion with return of previous round wagering, less casino commission. Under prior art, players who leave the game are not entitled to a return of accumulated wagering after exit.

Current method of casino table gaming is paradox of solitary wagering while being surrounded by crowds of strangers. Unique table layout includes a social aspect to wagering with partner play designed to promote camaraderie and reduce cost of individual wagering.

Resolution of financial obligation under prior art is accomplished by providing payout odds lower than odds of winning. The system of invention during certain rounds of game play provides payout odds greater than odds of winning, which is commonly referred to as advantage play.

Advantaged play in gambling is well known as a player having an advantage over the casino. Blackjack is a game well known to enable player advantage by means of card counting. Casinos and gamblers are in a constant game of cat and mouse, putting casinos under burden and cost of security surveillance. Furthermore, casinos during periods of slow play might offer a coupon for advantage play, typically known as match play. The marketing and execution of which is also costly to the casino. The system of the invention provides casino sponsored advantaged play without employing costs of additional security, or marketing costs associated with match play coupons. Innovation of table layout allows for advantaged play to be determined without benefit of mechanical computation.

SUMMARY OF THE INVENTION

The object of the invention is to create a system of wager accumulation with advantaged play, calculated without benefit of mechanical computation. Of additional importance is the ability of players to enter and exit the game before its conclusion, so catchup wagering upon entry, and refund of accumulated wagers upon exit are major features of the game. Optional partner play will promote team play and reduce individual cost of wagering.

BRIEF DESCRIPTIONS OF THE DRAWINGS

Figure 1A:
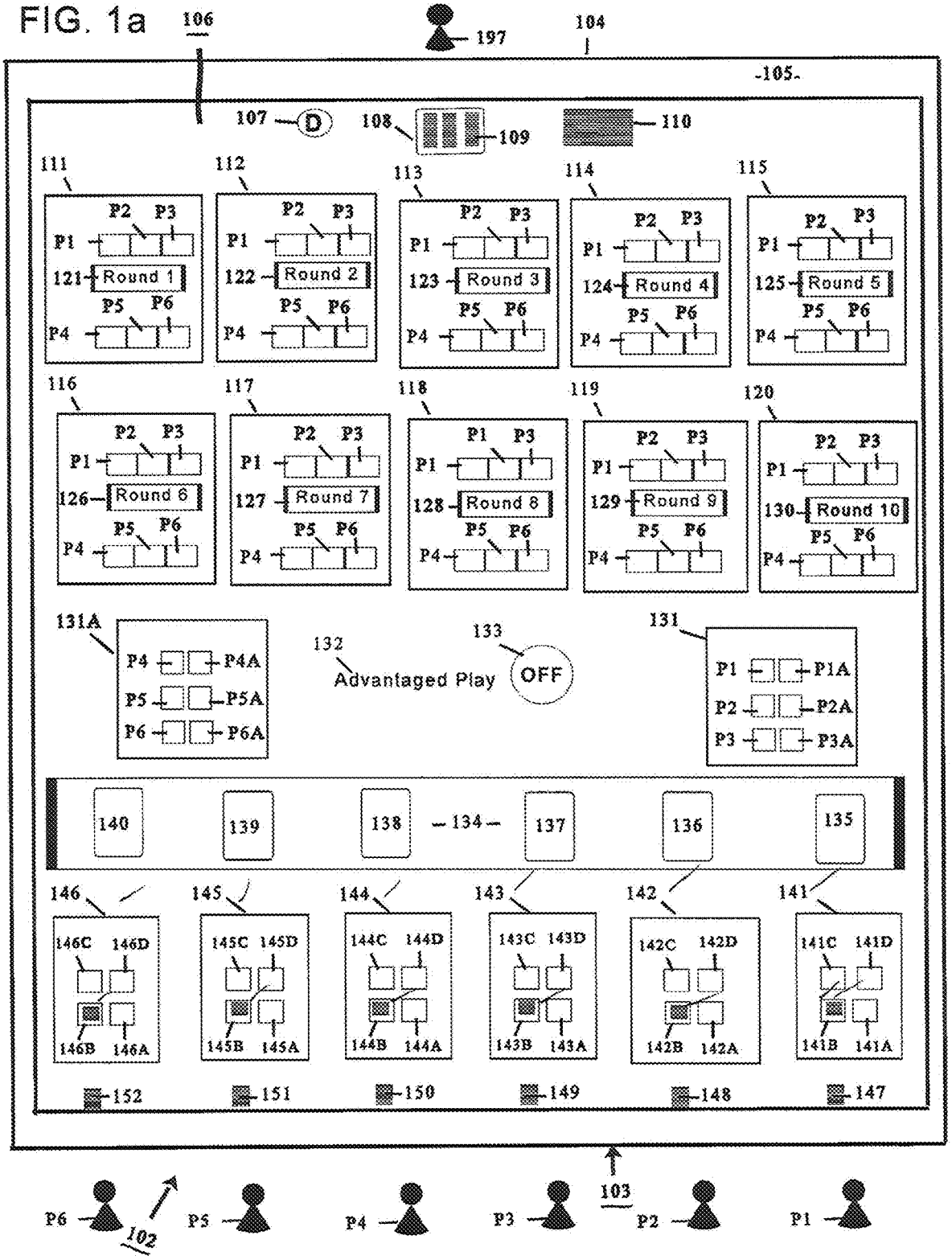
Figure 1B:
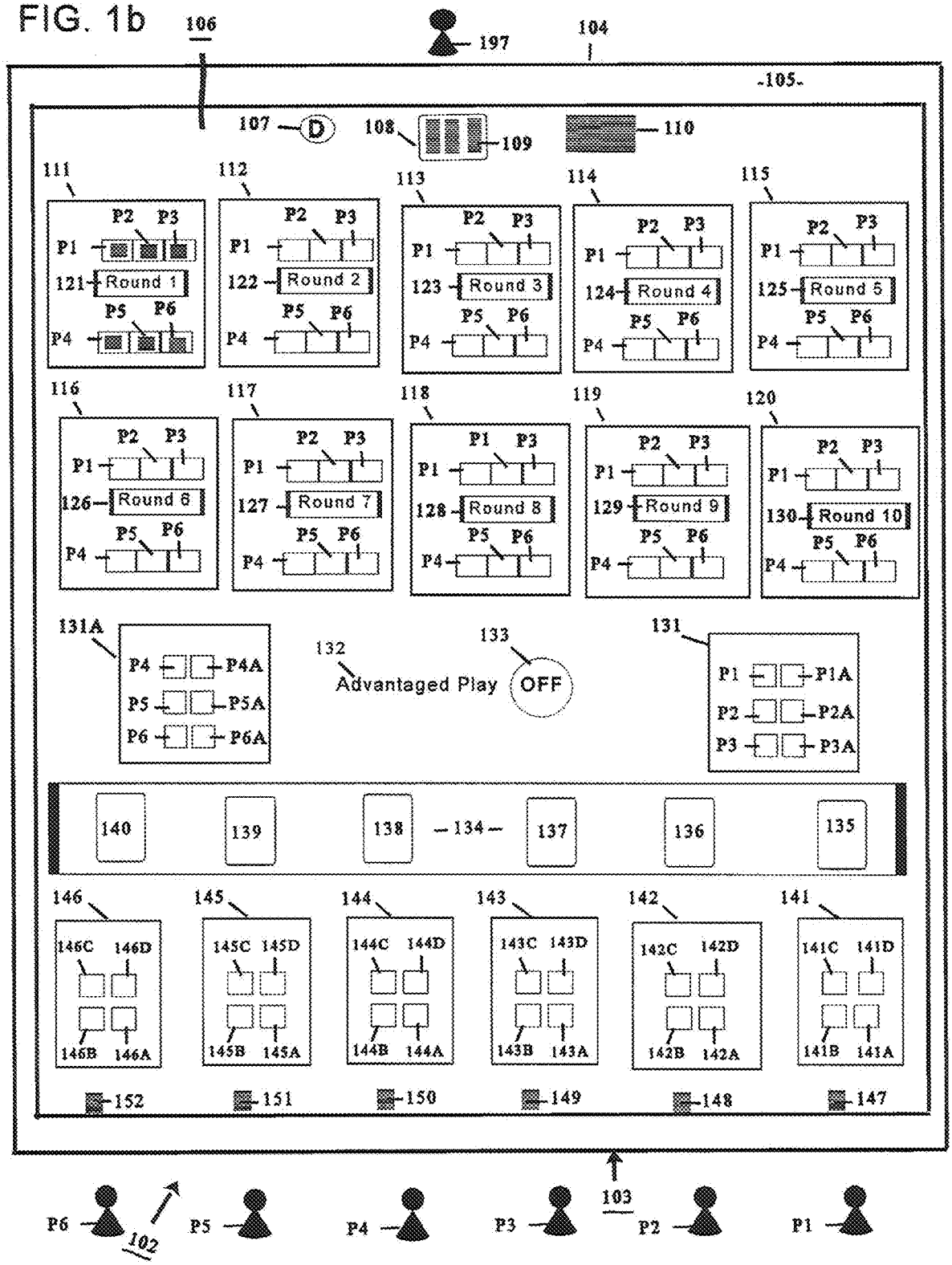
Figure 1C:
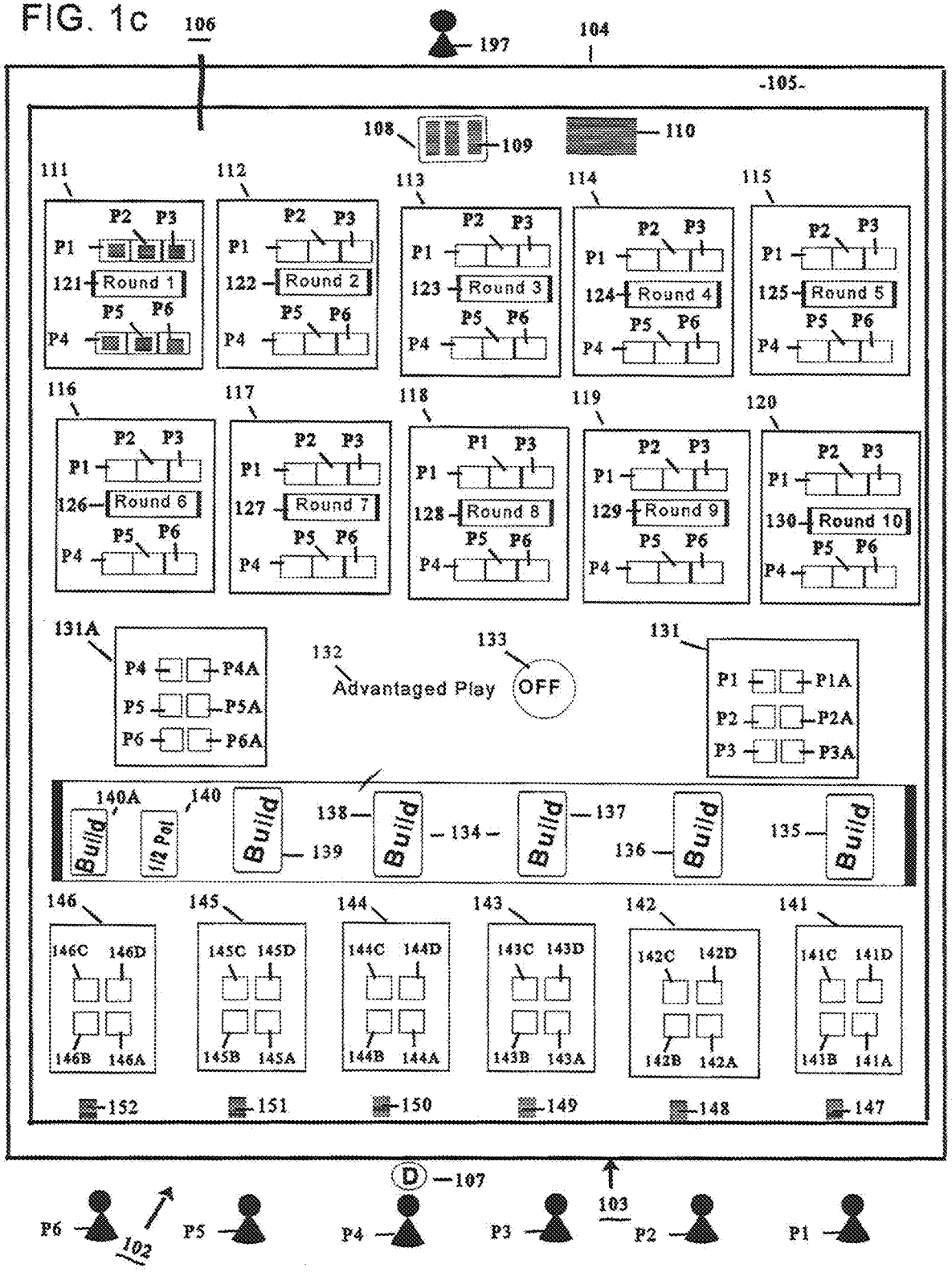
Figure 1D:
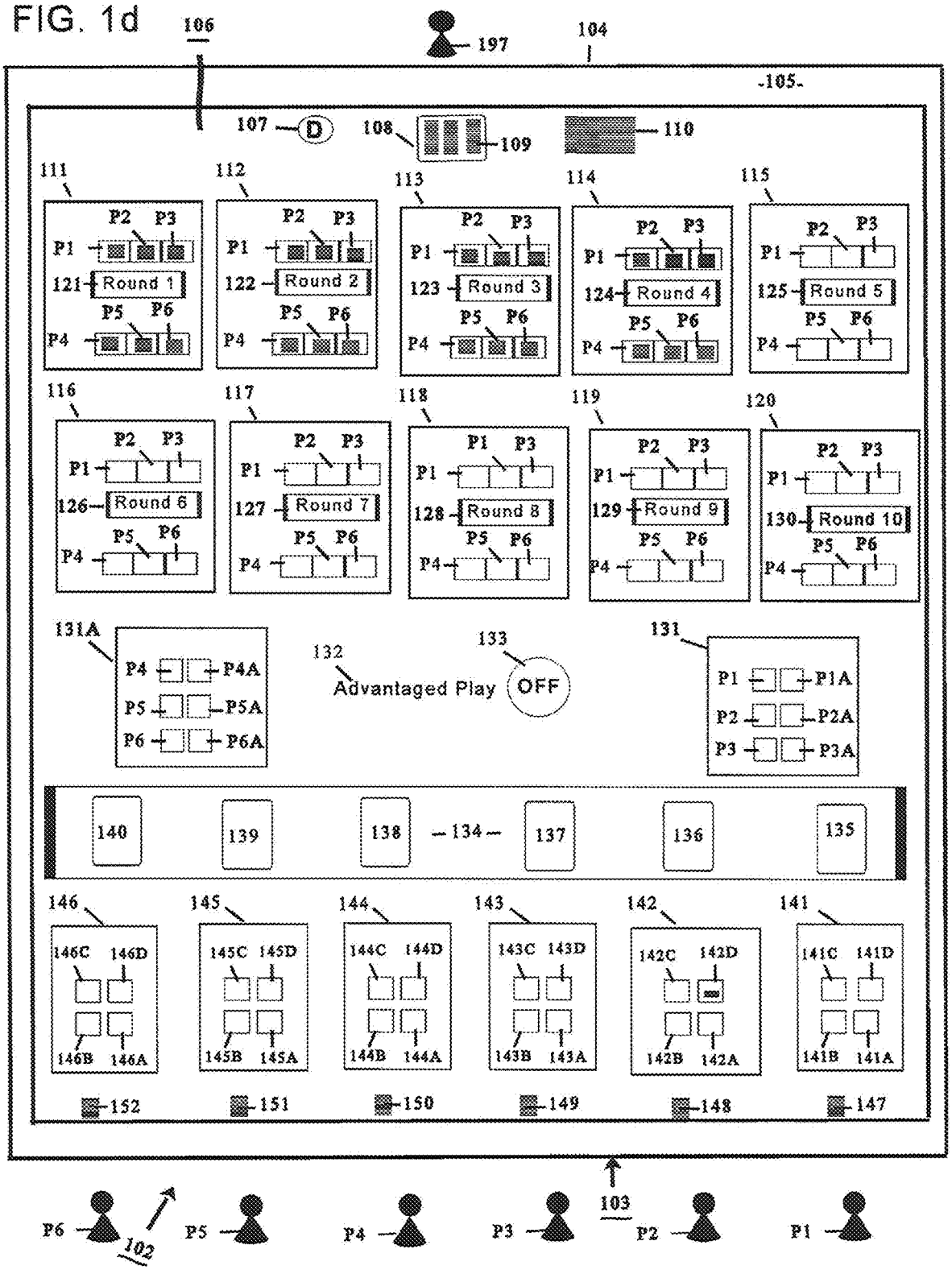
Figure 1E:
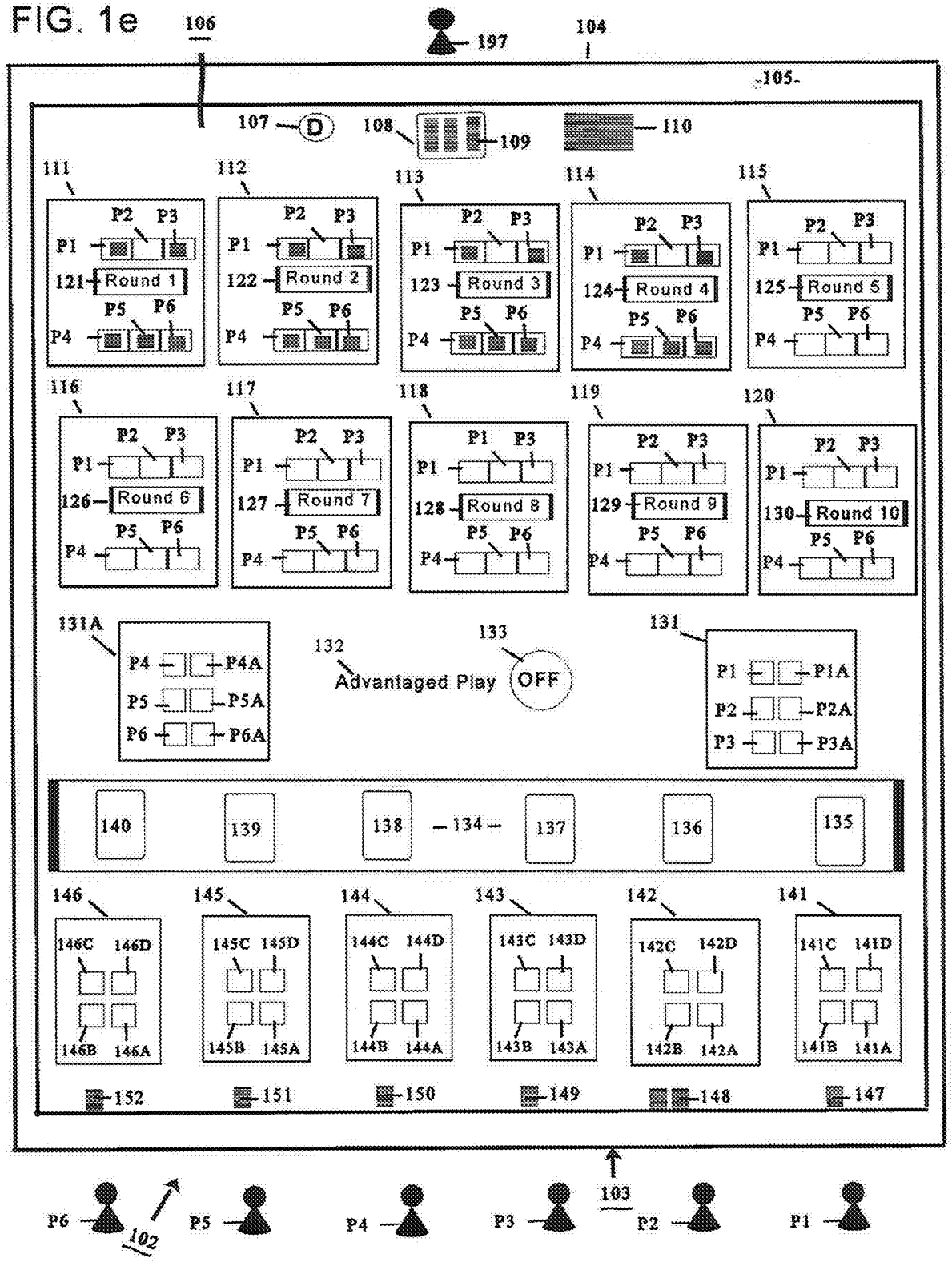
Figure 1F:
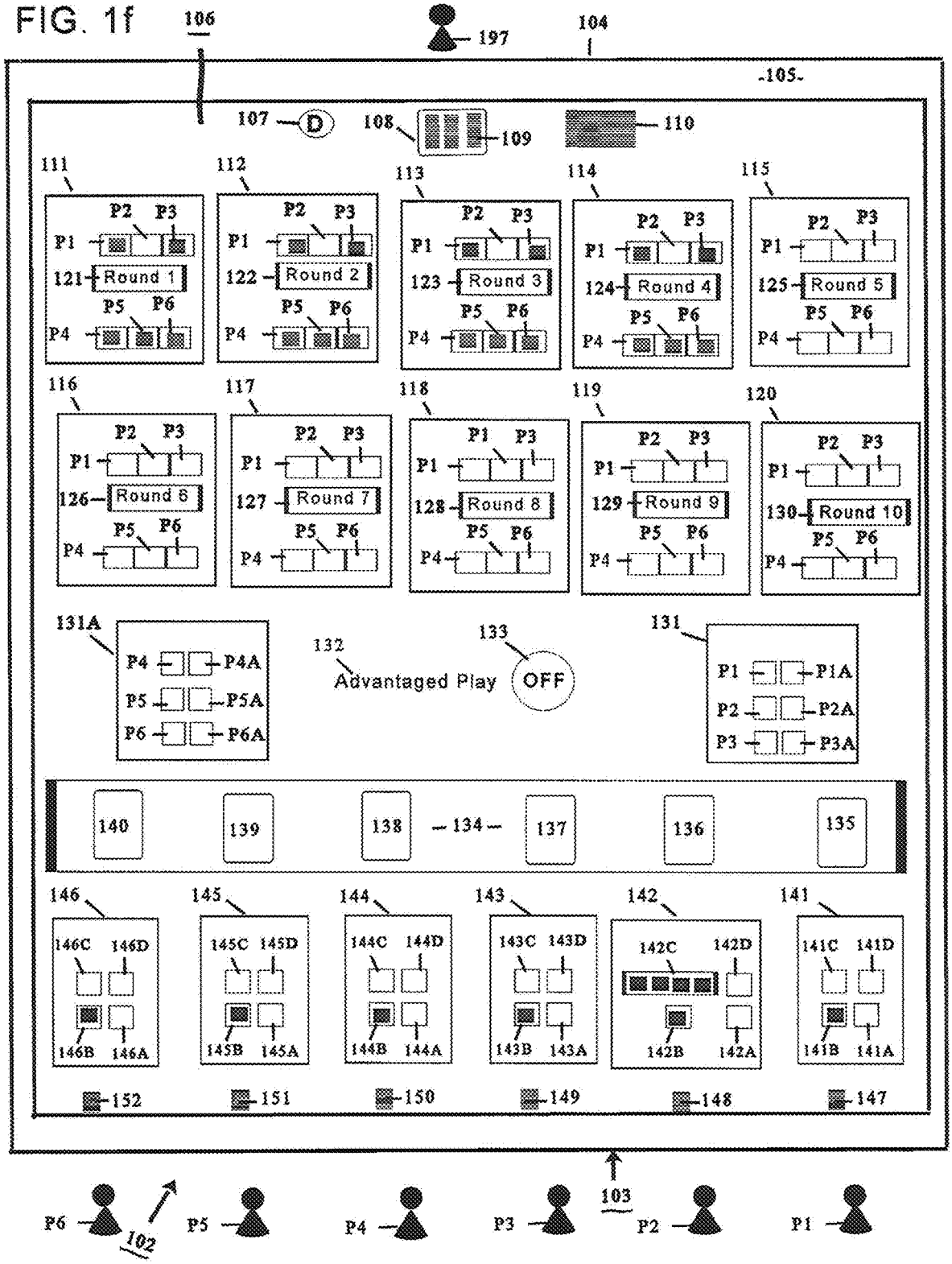
Figure 1G:
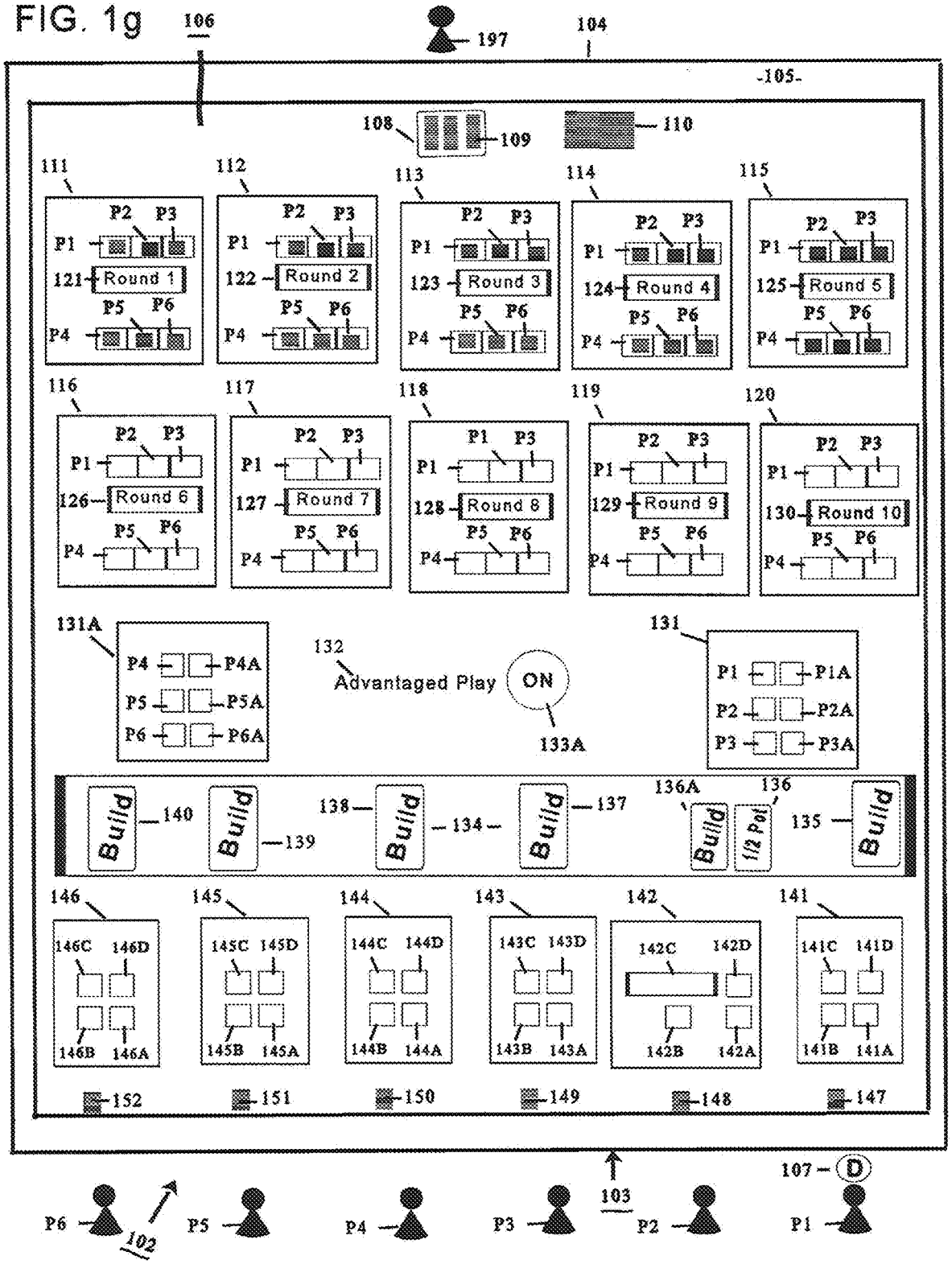
Figure 1H:
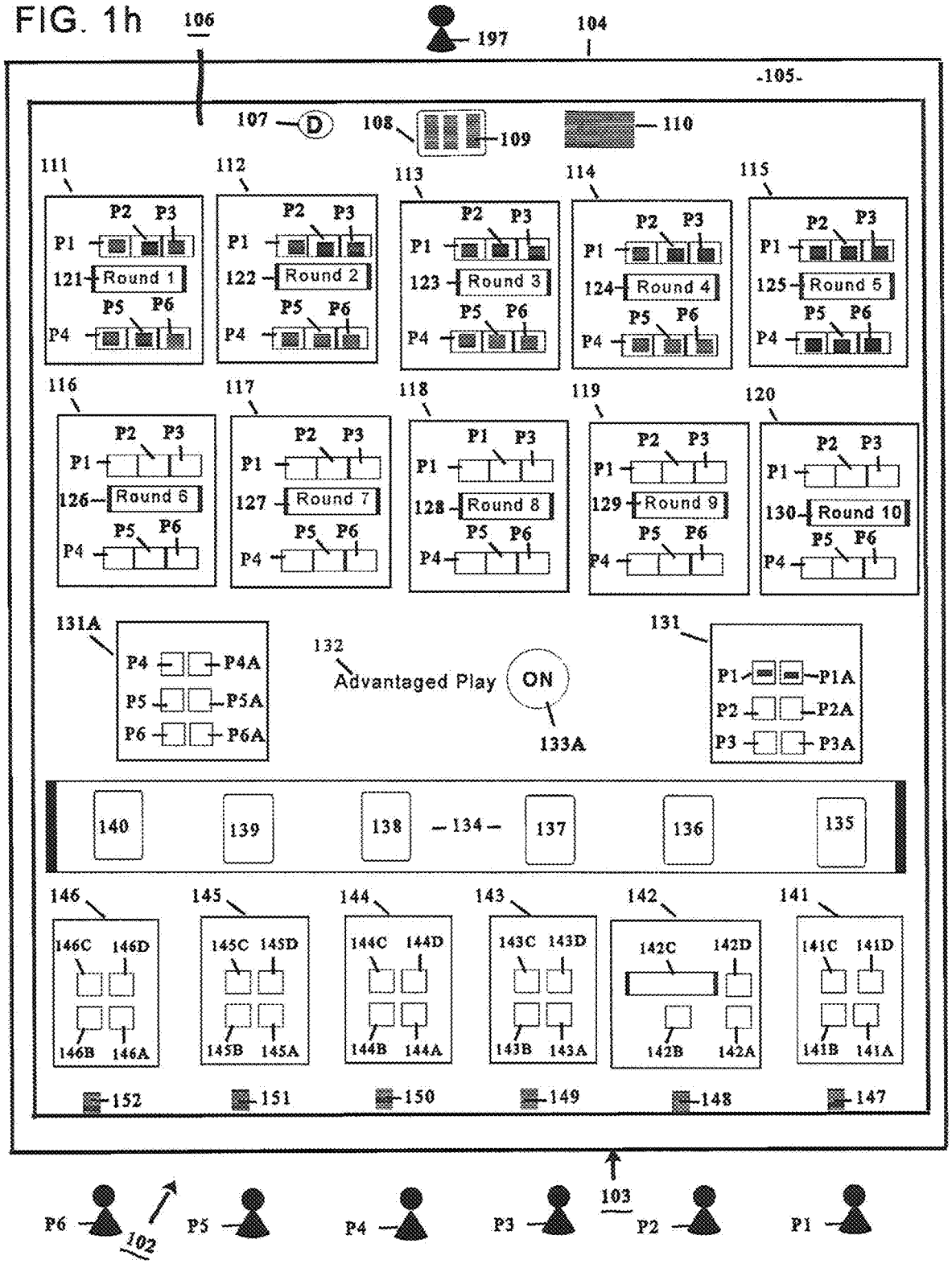
Figure 1I:
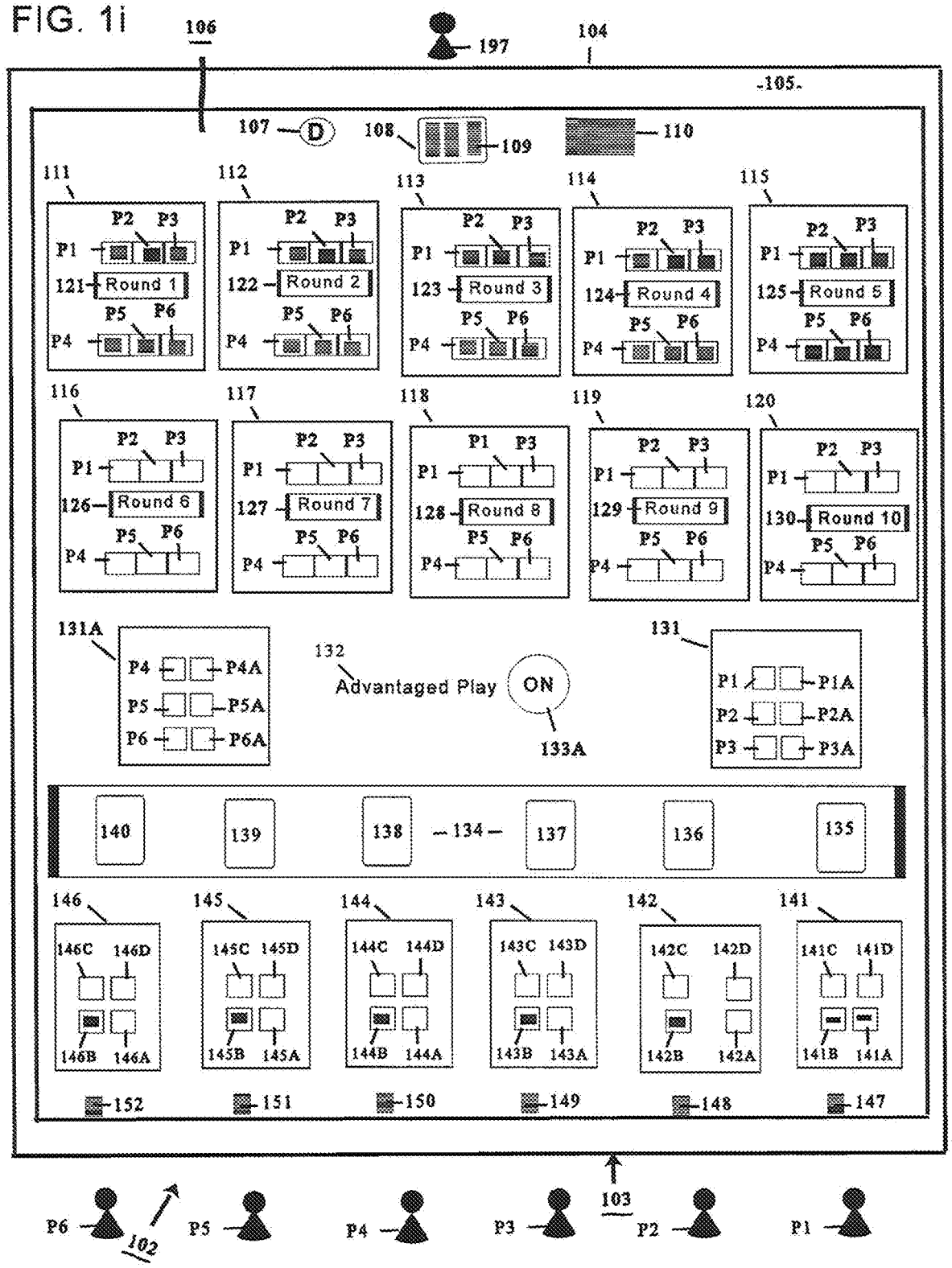
Figure 1J:
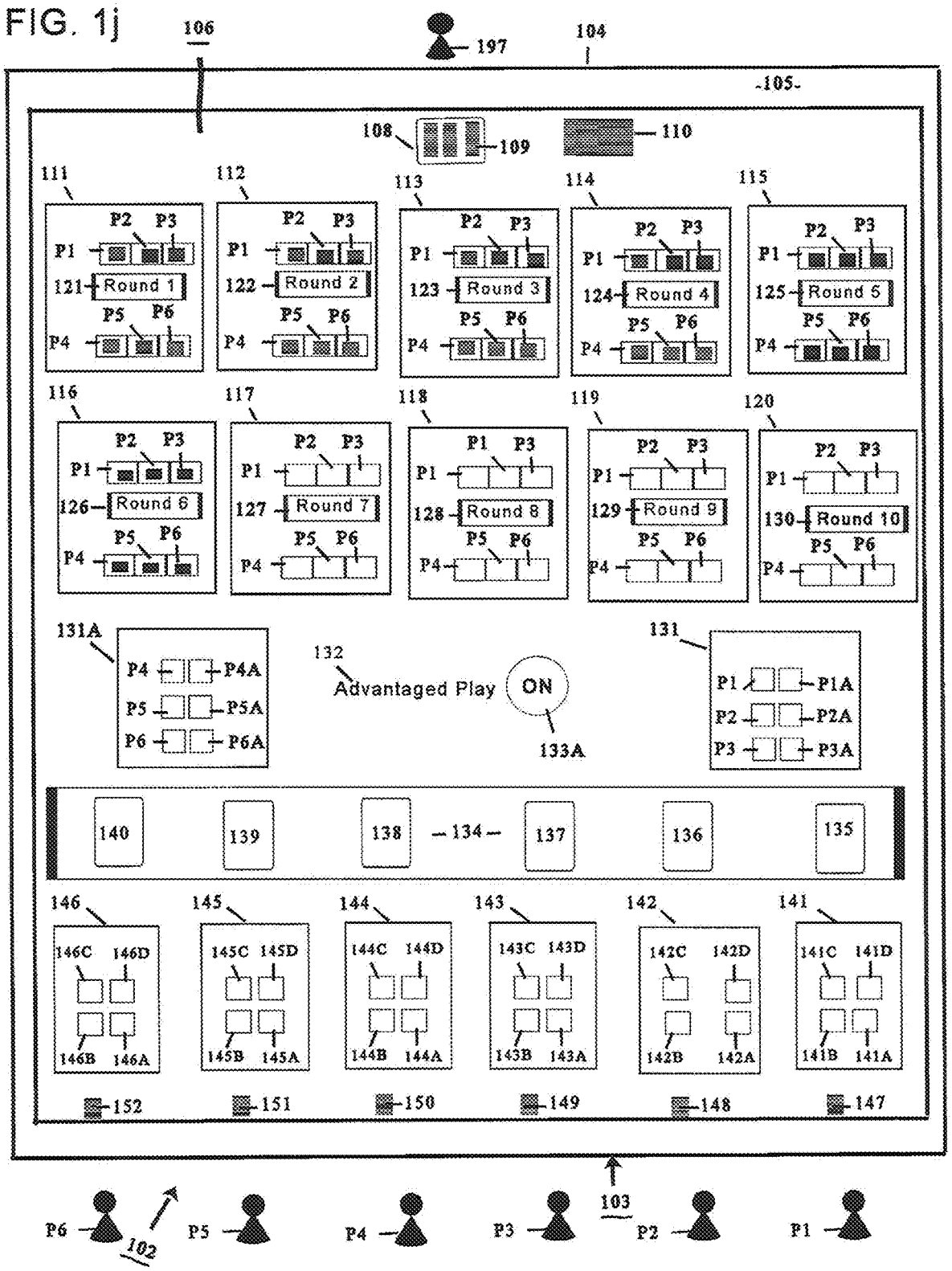
Figure 1K:
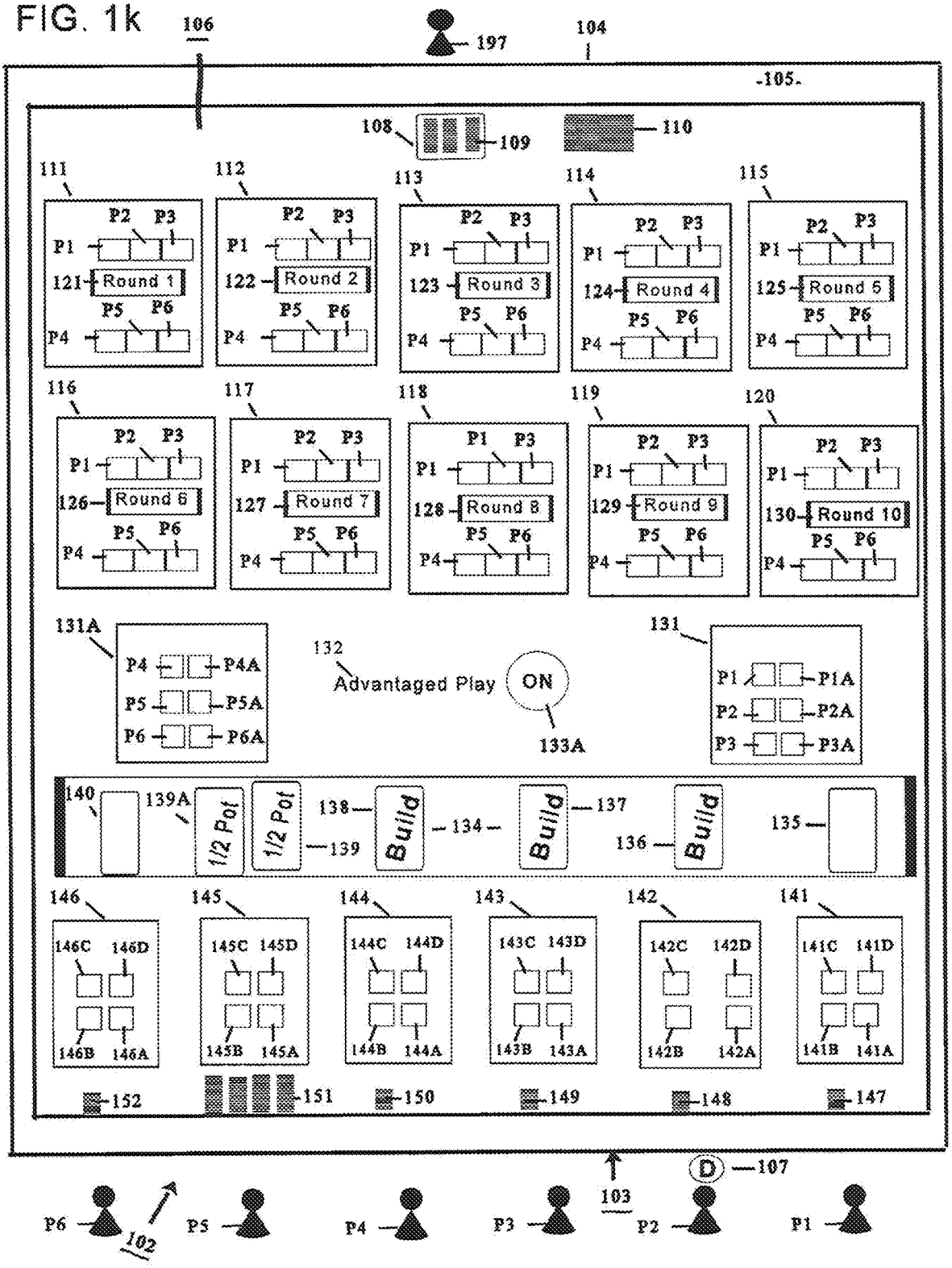
Figure 2:
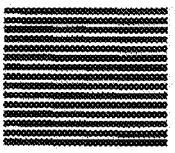
Figure 2:
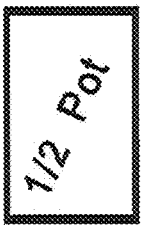
Figure 2:
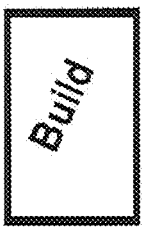
Figure 4:
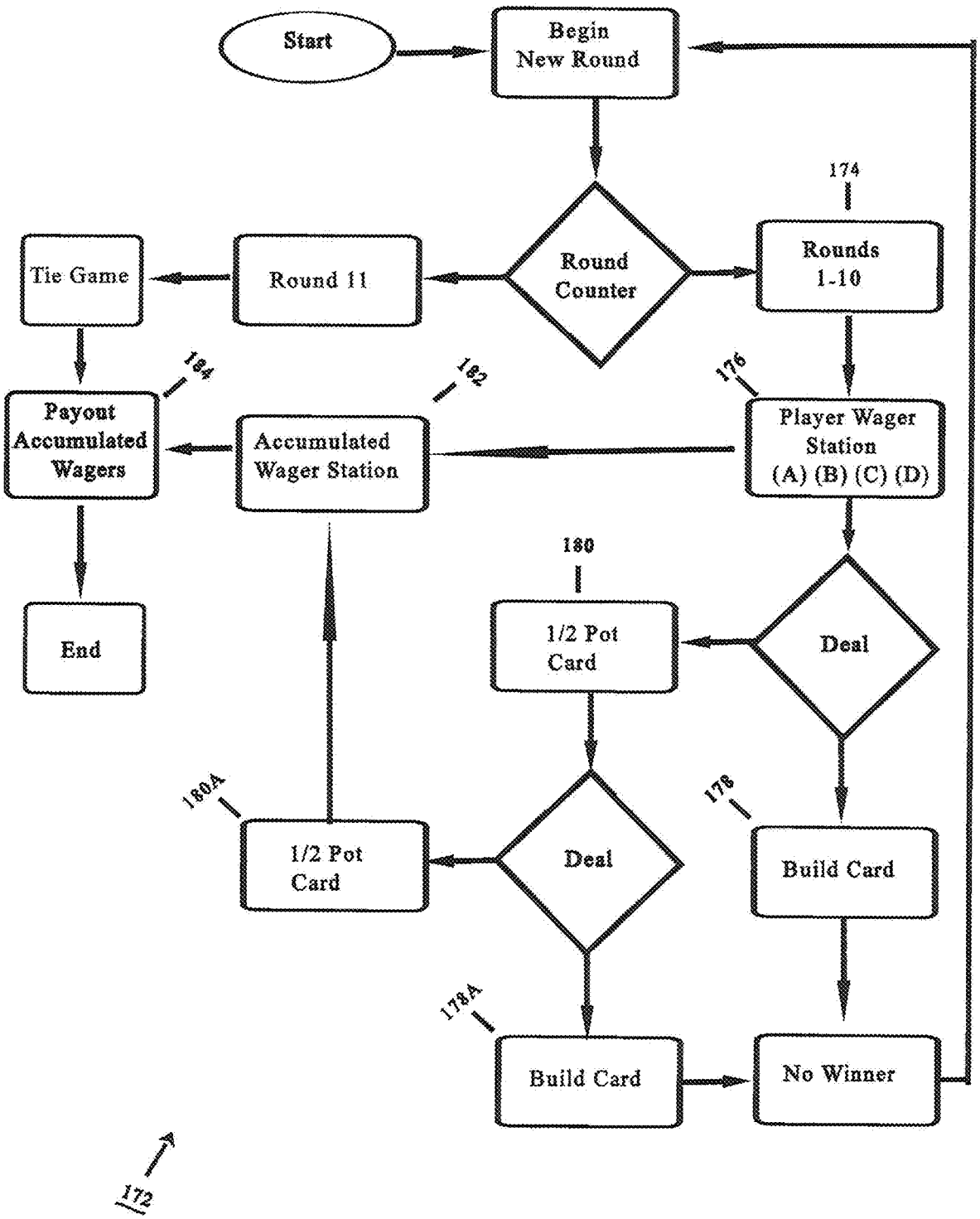

FIG. 1 Illustration of game table layout in accordance with the system of the invention;

FIG. 1*a* Illustration of placement of standard wagers into player wagering stations;

FIG. 1B depicts transfer of wagers from player wagering stations into wager accumulation stations;

FIG. 1*c* Illustration of cards received by players;

FIG. 1*d* Illustration of player electing to exit the game;

FIG. 1*e* Illustration of return of wagers from wager accumulation stations to exiting player;

FIG. if Illustration of new player catchup wagering and standard player wagering;

FIG. 1*g* Illustration of catchup wagering transferred into wager accumulation stations and standard wagering transferred into new round of wager accumulation station;

FIG. 1*h* Illustration of partner play request and acceptance;

FIG. 1*i* Illustration of placement of player standard wagering and partner wagering into player wagering stations;

FIG. 1*j* Illustration of placement of wagers from player wagering station into new wager accumulation station;

FIG. 1*k* Illustration of cards received by players with representation of winning combination of cards and transfer of accumulated wagers to chip stack of winning player;

FIG. 2 Representations of deck composition, win probability, odds conversion, and probability of wager accumulation by round;

FIG. 3 Representation of when advantaged play is available by individual round;

FIG. 4 Schematic illustration of the main features of the system of invention.

DETAILED DESCRIPTION OF THE INVENTION

Referring to figures in general and FIG. 1 in particular a system 102 of accumulating wagering for a type card game is illustrated. System 102 includes a table 103 (legs not shown), dealer's side 104, rail 105, dealer 197, and players, P1, P2, P3, P4, P5, P6 (a maximum of six players is provided for in the preferred embodiment) located at opposite end of the table from dealer. Table surface (layout) 106 includes dealer button 107, chip rack 108, which houses dealer chips 109, card deck 110, located near plurality of wager accumulation stations 111, 112, 113, 114, 115, 116, 117, 118, 119, 120. Plurality of partner play stations 131 and 131A occupy near middle of the layout nearby letters which spell, "Advantaged Play 132". An Off button 133 occupies space by advantaged play lettering. Card distribution area 134 and plurality of boxes 135, 136, 137, 138, 139, 140 depict location for card distribution which is located by plurality of player wagering stations 141, 142, 143, 144, 145, 146 and plurality of player chips 147, 148, 149, 150, 151, 152.

All wagering of system 102 is of a standard and equal amount by any player. FIG. 1*a*, illustrates placement of player P1 wager in player wagering station 141, precisely into box 141B, and placement of player P2 wager in player wagering station 142, precisely into box 142B, and placement of player P3 wager in player wagering station 143, precisely into box 143B, and placement of player P4 wager in player wagering station 144, precisely into box 144B, and placement of player P5 wager in player wagering station 145, precisely into box 145B, and placement of player P6 wager in player wagering station 146, precisely into box 146B.

FIG. 1*b*, depicts transfer by dealer 197 of player P1 wager formerly located in player wagering station 141 to wager accumulation station 111, precisely into accumulated wager box P1, and transfer by dealer 197 of player P2 wager formerly located in player wagering station 142 to wager accumulation station 111, precisely into accumulated wager box P2, and transfer by dealer 197 of player P3 wager formerly located in player wagering station 143 to wager accumulation station 111, precisely into accumulated wager box P3, and transfer by dealer 197 of player P4 wager formerly located in player wagering station 144 to wager accumulation station 111, precisely into accumulated wager box P4, and transfer by dealer 197 of player P5 wager formerly located in player wagering station 145 to wager accumulation station 111, precisely into accumulated wager box P5, and transfer by dealer 197 of player P6 wager formerly located in player wagering station 146 to wager accumulation station 111, precisely into accumulated wager box P6.

Accumulated wagers in wager accumulation station 111 equal a total of six, which is an amount insufficient to offer advantaged play 132, so advantaged play button 133 remains in off position. Advantaged play is calculated by addition of all wagers placed in all wager accumulation stations and then compared to odds of winning, 27.22:1.

Referring to FIG. 1*c*, dealer 197 has established order of deal by placement of dealer button 107 in front of randomly selected player P4. As illustrated, cards are represented in card distribution box 134. In order of deal, player P4 received Build card 138, which immediately eliminates player P4 from the round. In order of deal, player P5 received Build card 139, which immediately eliminates player P5 from the round. In order of deal, player P6 received ½ Pot card 140, which entitles player to receive an immediate second card, which as shown is Build card 140*a*, which immediately eliminates player P6 from the round. In order of deal, player P1 received Build card 135, which immediately eliminates player P1 from the round. In order of deal, player P2 received Build card 136, which immediately eliminates player P2 from the round. In order of deal, player P3 received Build card 137, which immediately eliminates player P3 from the round. Since all players have been eliminated from the round, a new round of game play will begin with resultant wager accumulation.

Any player may exit the game at the start of the round with a refund of wagers particular to that player from all previous rounds played of the existing game. Referring to FIG. 1*d*, player P2 has elected exit by placement of single player chip 148 in player wagering station 142, precisely into box 142D. As further illustrated player P2 has completed standard wagers for round one 121, round two 122, round three 123, and round four 124, of respective wager accumulation stations 111, 112, 113, 114 which entitles player P2 to refund of four standard wagers less casino commission.

Referring to FIG. 1*e*, wager accumulation stations 111, 112, 113, 114 for player P2 now sit empty, representing that Dealer 197 has returned four standard wagers less casino commission to Player P2 chip stack 148 illustrated as increased. Dealer commission is returned to dealer chip box 108.

A new player at the beginning of any around may take an unoccupied player position and enter the game provided that new player makes appropriate catchup wager. FIG. 1*f*, as illustrated wager accumulation stations 121,122,123,124 for player P2 now stand empty. In order to catch up on rounds of missed wagering, new player P2 placed four standard wagers into player wagering station 142, precisely into box 142C. As further represented, players P1, P2 P3, P4, P5, P6 continue the round in analogous fashion having placed standard wagers in respective player wagering stations 141, 142, 143, 144, 145, 146 and precisely into boxes 141B, 142B, 143B, 144B, 145B, 146B.

Referring to FIG. 1*g*, dealer 197 has transferred one catchup wager formerly contained in player P2, wagering station 142, box 142C into wager accumulation station 111, precisely into box P2, and one catchup wager formerly contained in player P2, wagering station 142, box 142C into wager accumulation station 112, precisely into box P2, and one catchup wager formerly contained in player P2, wagering station 142, box 142C into wager accumulation station 113, precisely into box P2, and one catchup wager formerly contained in player P2, wagering station 142, box 142C into wager accumulation station 114, precisely into box P2. In analogous fashion, wagers formerly placed by players P1, P2 P3, P4, P5, P6 in player wagering stations 141, 142, 143, 144, 145, 146. have been transferred by dealer 197 to wager accumulation station 115, precisely into accumulation boxes P1, P2 P3, P4, P5, P6, representing round five 125 of the game.

Advantaged play is determined in analogous fashion. As illustrated accumulated wagers for six players, P1, P2, P3, P4, P5, P6 in five wager accumulation stations, 111, 112, 113, 114, 115 is shown to total thirty, an amount sufficient for dealer 197 to signal advantaged play 132 with "ON" button 133A, which notifies players that advantaged play is available. In further analogous fashion, cards distributed in card distribution area 134 represent no winning combination of cards, so game will continue to the next round with resultant wager accumulation.

Any player without current benefit of partner play may request partner play at the beginning of any round. Referring to FIG. 1*h*, chip placement by player P1 in partner play station 131, precisely into box P1, depicts request for partner play. As further depicted, a separate player has accepted partnership with placement of playing chip in partner play station 131, precisely into box P1A. Partner play station 131 is designed for use by players P1, P2, P3. Partner play station 131A is designed for use by players P4, P5 and P6.

Referring to FIG. 1*i*, players P2, P3, P4, P5, P6 placed standard wagers in player wagering stations 142, 143, 144, 145, 146, and precisely into boxes 142B, 143B, 144B, 145B, 146B. Player P1 and partner now evenly share standard wagering with player P1 placement of fifty percent of standard wager in player wagering station 141, precisely into box 141B, and partner of player P1 placement of fifty percent of standard wager in player wagering station 141, precisely into box 141A.

Referring to FIG. 1*j*, in analogous fashion, dealer 197 has transferred wagers formerly contained in player wagering stations, 141, 142, 143, 144, 145, 146 from boxes 141A, 141B, 142B, 143B, 144B, 145B, 146B to first open wager accumulation station 116, precisely into accumulation boxes P1, P2, P3, P4, P5, P6 representing round six of game play, 126. Accumulated wagers from six players contained in six accumulated wagering stations totals thirty-six accumulated wagers and advantaged play 132 button is On 133A.

Referring to FIG. 1*k*, dealer 197 has established order of deal by placement of dealer button 107 in front of randomly selected player P2. In order of deal, player P2 received Build card 136 in card distribution area 134, which immediately eliminates player P2 from the round. In order of deal, player P3 received Build card 137 in card distribution area 134, which immediately eliminates player P3 from the round. In order of deal, player P4 received Build card 138 in card distribution area 134, which immediately eliminates player P4 from the round. In order of deal, player P5 received ½ Pot card 139 in card distribution area 134, which entitles player P5 to receive an immediate second card, which as shown is ½ pot card 139A. A winning combination of cards makes P5 winner of the game. The game is over, and order of deal is concluded, therefore players P6 and P1 are not entitled to receive cards. All accumulated wagers of all players previously placed in wager accumulation stations 111, 112, 113, 114, 115, 116, less casino commission are placed in player P5 chip stack 151 represented by increase in size of chip stack. Casino commission is placed in dealer chip box 108.

Referring to FIG. 2, a deck of fifty total cards 110, comprised of ten, one-half pot cards designated by fractional notation of ½, with letters which spell, "Pot", 154. The remaining deck composition consists of forty, Build cards 156 designated by letters which spell, "Build". The probability of a player receiving winning combination of back-to-back, ½ Pot cards in immediate succession 158. Probability converted to odds of winning 160. In order to determine game feasibility of wager accumulation, inventor commissioned a computer simulation of one million games 162, which demonstrated probability of sufficient multi-round play with resultant probability of wager accumulation 162A.

Resolution of financial obligation of the system of the invention is based on accumulated wagers as transferred by dealer from wager accumulation stations to winning player. Referring to FIG. 3, accumulated wagers in a wager accumulation station representing one round could be as low as six accumulated wagers 164. Accumulated wagers in a wager accumulation stations representing ten rounds could be as high sixty accumulated wagers 166. Settlement of financial obligation increases round by round, therefore it is not dependent on stagnant odds created during distribution of cards 168. As further illustrated, advantaged play is available during rounds when accumulated wagers 170, 170A, 170B, 170C, 170D, 170E exceed odds of winning 27.22:1.

Referring to FIG. 4, game schematic 172 of the system of the invention and in particular multi-round play 174, player wagering station 176, losing card 178, 178A, winning card combination 180, 180A, wager accumulation station 182 and payout of accumulated wagers 184.

Although the invention has been particularly shown and described with reference to preferred embodiments thereof, it will be understood by those skilled in the relevant art that various changes in form and details such as electronic media may be made therein without departing from the spirit and scope of the invention.

What is claimed:

1. A system for conducting a multi-round wager accumulation card game in a casino, comprising:

a gaming table having a table surface with:

a plurality of player wagering stations each configured to receive a standard wager from a corresponding player;

a plurality of wager accumulation stations, each associated with a specific round of gameplay and configured to store standard wagers transferred from the plurality of player wagering stations;

at least one card distribution area;

an advantaged play ON/OFF button;

one or more partner play stations for partnership wagering among players;

a deck of fifty cards consisting of:

forty build cards; and ten half-pot cards;

a dealer interface comprising:

a dealer chip rack also configured to receive a casino commission;

a dealer button for establishing card distribution order;

wherein the system is implemented according to steps of:

the plurality of players occupying players positions at the gaming table;

accepting equal standard wagers from the plurality of players into respective player wagering stations;

transferring the standard wagers from the plurality of player wagering stations into corresponding wager accumulation stations by round and player;

distributing one or more cards from the deck of fifty cards to each player in an established order;

immediately eliminating from a round the player receiving a build card;

declaring a game winner the player receiving two half-pot cards in immediate succession, and transferring all accumulated wagers from all the wager accumulation stations to that player;

continuing gameplay in subsequent rounds with continued wager accumulation if no player receives a winning combination, for up to a maximum of ten rounds;

enabling any player to exit the multi-round wager accumulation card game at a start of the round and receive a refund of accumulated wagers, less a casino commission;

permitting a new player to take an unoccupied player position and enter the wager accumulation card game at the start of the round by placing catchup wagers equal to missed wagers in prior rounds;

computing when total accumulated wagers across rounds exceed a threshold based on odds of winning, and set the advantaged play ON/OFF button to ON when the threshold is crossed;

wherein the system is configured for partner play where a second player places a portion of the standard wagers in a first player partner play station.

2. The system of claim 1, wherein the deck of fifty cards provides a winning probability of 1 in 27.22 games based on the player receiving two half-pot cards in succession.

3. He system of claim 2, wherein the threshold is 27.22 standard wagers.

4. The system of claim 1, wherein the player partner play stations are divided into separate regions assigned to predefined subsets of players based on the players positions at the gaming table.

5. The system of claim 1, wherein wager accumulation stations are segmented by both round number and player position at the gaming table to visually track individual contribution.

* * * * *